US009051723B2

(12) United States Patent
Junca

(10) Patent No.: US 9,051,723 B2
(45) Date of Patent: Jun. 9, 2015

(54) FASTENER ASSEMBLY FOR TOILET AND METHOD

(76) Inventor: Charles H. Junca, Sunset, LA (US)

( * ) Notice: Subject to any disclaimer, the term of this patent is extended or adjusted under 35 U.S.C. 154(b) by 183 days.

(21) Appl. No.: 13/494,189

(22) Filed: Jun. 12, 2012

(65) Prior Publication Data

US 2013/0326801 A1 Dec. 12, 2013

(51) Int. Cl.
*E03D 11/16* (2006.01)

(52) U.S. Cl.
CPC ..... *E03D 11/16* (2013.01)

(58) Field of Classification Search
USPC ..... 4/252.1–252.6; 411/187, 338
See application file for complete search history.

(56) References Cited

U.S. PATENT DOCUMENTS

| | | | | | |
|---|---|---|---|---|---|
| 2,765,017 | A | * | 10/1956 | Robbins | 411/144 |
| 3,180,660 | A | * | 4/1965 | Brewington | 285/60 |
| 3,262,590 | A | | 7/1966 | Lynn | |
| 3,391,905 | A | | 7/1968 | Burnes | |
| 3,419,298 | A | * | 12/1968 | Worley | 403/24 |
| 4,492,500 | A | * | 1/1985 | Ewing | 411/5 |
| 4,722,511 | A | | 2/1988 | Chitwood | |
| 4,850,063 | A | * | 7/1989 | Abbate | 4/252.1 |
| 5,203,065 | A | | 4/1993 | Peters | |
| 5,373,593 | A | | 12/1994 | Decky et al. | |
| 5,505,430 | A | | 4/1996 | Barnett | |
| 5,556,076 | A | | 9/1996 | Jacquay | |
| 5,897,101 | A | | 4/1999 | Snyder | |
| 6,015,137 | A | | 1/2000 | Guevara et al. | |
| 6,135,466 | A | | 10/2000 | Irwin | |
| 6,254,141 | B1 | * | 7/2001 | Piper | 285/56 |
| 6,367,093 | B1 | * | 4/2002 | Hawro | 4/252.1 |
| 6,416,039 | B1 | | 7/2002 | Pietrusynski | |
| 6,685,170 | B1 | | 2/2004 | Gwynn | |
| 6,752,379 | B1 | | 6/2004 | Wall | |
| 6,886,192 | B1 | | 5/2005 | Merrill | |
| 6,966,542 | B2 | | 11/2005 | Bettencourt | |
| 7,137,615 | B2 | | 11/2006 | Ray et al. | |
| 7,303,181 | B1 | | 12/2007 | Nymann | |
| 7,798,469 | B2 | | 9/2010 | Junca | |

* cited by examiner

*Primary Examiner* — Lauren Crane
(74) *Attorney, Agent, or Firm* — Jones Walker LLP

(57) ABSTRACT

An apparatus for bolting down a flange. The flange is operatively associated with a structural interface having an opening. The structural interface may be a toilet. The apparatus comprises a fastener assembly disposed through the flange slot, and the fastener assembly includes: a base configured to engage the flange; a bolt shaft with an inner bore, wherein said bolt shaft is connected to the base, and a fastener selectively attachable to the bolt shaft. The apparatus also includes a cap operatively configured to selectively engage the bolt shaft. A method of attaching a flange to a foundation is also disclosed.

10 Claims, 4 Drawing Sheets

FASTENER ASSEMBLY FOR TOILET AND METHOD

BACKGROUND OF THE INVENTION

This invention relates to a fastening assembly, method and system. More particularly, but not by way of limitation, this invention relates to a fastener assembly and method to fasten and unfasten a toilet to or from a flange.

In the construction, maintenance, and remodeling industry, contractors, plumbers and maintenance technicians, often find it necessary to replace old commodes for either repair or replacement. Due to the structural nature of commodes, installing, lifting, moving, aligning and lowering of the toilets is cumbersome and awkward. Additionally, the method of unfastening the toilet foundation from a floor flange is also cumbersome, awkward and very time consuming. The prior art methods, which includes bolting the toilet base to the floor flange is awkward, unstable and outdated. Also, many flanges are broken from over tightening present day bolts.

With prior art toilets, a contractor may need wrench, pliers, channel locks, as well other tools, to tighten down or remove a toilet. Moreover, due to the nature of the toilet's environment, a contractor working either to install or remove a toilet, desires to quickly and efficiently perform the necessary task and move on to the next. The prior art method of installing bolt caps requires the old style bolts to be cut with a hack saw, bolt cutter, or saw, since the bolts are too long.

SUMMARY OF THE INVENTION

In one embodiment, an apparatus for attaching a toilet to a flange is disclosed. The apparatus comprises a fastener assembly operatively associated with a flange slot, a guide bolt configured to selectively engage the fastener assembly and position the toilet in proper alignment relative to the flange slot, and a cap operatively configured to selectively engage the fastener assembly when the guide bolt is removed so that the toilet is attached to the flange. The fastener assembly includes a base configured to engage the flange, a bolt shaft with an inner bore, wherein the bolt shaft is connected to the base, wherein the guide bolt is selectively engaged with the inner bore, and a nut selectively attachable to the bolt shaft.

In this embodiment, the bolt shaft may contain a distal indentation for cooperation with an aperture contained within a foundation of the toilet. Also, the cap may have a proximal gripping end and a distal end, and wherein the distal end is operatively configured to engage with the inner bore of the bolt shaft. Additionally, with one embodiment, the distal end may contain an outer thread member and wherein the bolt shaft's inner bore contains an inner thread member that engages with the distal end's outer thread member and the cap may have a receptacle, adjacent the distal shaft, for placement of the bolt shaft when the cap is engaged with the bolt shaft.

A method of attaching a flange to a foundation of a toilet is also disclosed. In one embodiment, the method comprises providing a fastener assembly positioned through a flange slot on the flange, with the fastener assembly including a bolt shaft with an inner bore, wherein the bolt shaft is connected to a base, a nut selectively attached to the bolt shaft and a guide bolt configured to selectively engage the inner bore of the bolt shaft, a cap having a proximal gripping end and a distal end, and wherein the distal end is operatively configured to engage with the inner bore of the bolt shaft, wherein the distal shaft contains an outer thread member and wherein the bolt shaft's inner bore contains an inner thread member that engages with the distal end's outer thread member. The method may include inserting the fastener assembly into the flange slot, positioning the guide bolt in an upright position (i.e. approximately vertical) relative to the flange, and lowering the toilet relative to the flange. The method may further include positioning the guide bolts through openings in the foundation when lowering the toilet, removing the guide bolts, and installing the cap onto the bolt shaft so that the flange is attached to the toilet. In one embodiment, the step of installing the cap onto the bolt includes threadedly connecting the distal end of the cap to the inner bore of the bolt shaft. When threadedly connecting the distal end to the inner bore of the bolt shaft, the method may include allowing the bolt shaft to advance into a receptacle formed on the cap. A fastener may also be placed down the bolt shaft when positioning the guide bolt in the vertical position relative to the flange. Also, in the step of positioning the guide bolts through the openings in the foundation, the method may include engaging a distal indentation of the bolt shaft with the openings of the toilet foundation as the openings of the toilet foundation are lowered over the guide bolts. A proximal indentation on the bolt may be included for cooperation with the flange slot. In one embodiment, the distal indentation is in a first orientation and the proximal indentation is in a second orientation opposite the distal's indentation's first orientation.

In another embodiment, an apparatus for bolting down a flange having a flange slot is disclosed. The flange is operatively associated with a structural interface having an opening. The apparatus includes a fastener assembly disposed through the flange slot, wherein the fastener assembly comprises: a base configured to engage the flange; a bolt shaft with an inner bore, wherein the bolt shaft is connected to the base, and a fastener selectively attachable to the bolt shaft. Also included is a cap operatively configured to selectively engage the bolt shaft, with the cap having a proximal gripping end and a distal end, and wherein the distal end is operatively configured to engage the inner bore of the bolt shaft and with the distal end containing an outer thread member so that the bolt shaft's inner bore contains an inner thread member that engages with the distal end's outer thread member. The cap may contain a receptacle, adjacent the distal end, for placement of the bolt shaft when the cap is engaged with the bolt shaft. Examples of fasteners includes a nut member and a lock spring. A guide post may be included that is configured to selectively engage the inner bore of the bolt shaft. The guide post may be used to guide the structural interface into position. In one embodiment, the structural interface is a commode.

Generally, toilets bolt to a floor flange, and floor flanges are attached to a sub floor and/or drain pipe. A contractor may find it necessary to use a hack saw or bolt cutter, which would ruin threads, making a future nut removal very difficult. An aspect of one of the disclosed embodiments is the elimination of having to use a hack saw or bolt cutter, and instead, a contractor can utilize the cap to bolt down the flange to the structural interface or unbolt the flange from the structural interface, which eliminates the need for wrenches, channel locks and other tools to tighten and untighten old style bolts and nuts. The structural interface may be a toilet. Other aspects of the disclosure may follow from this disclosure as will be readily apparent from the description that follows.

DETAILED DESCRIPTION OF THE PREFERRED EMBODIMENTS

Figure 1:
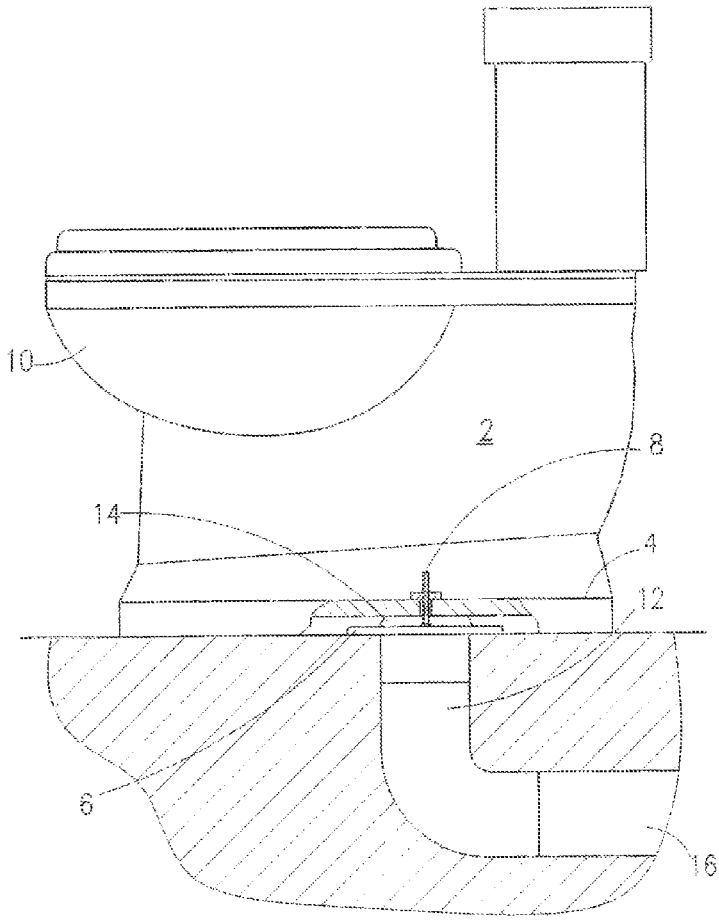
Fig. 1 PRIOR ART
FIG. 1 is a perspective view of a prior art toilet.

Referring now to FIG. 1, a perspective view of a prior art toilet 2 will now be described. As those of ordinary skill will appreciate, the toilet has a foundation 4. A floor flange 6 is bolted to the foundation 4 with the bolts 8. The toilet 2 has a bowl 10 that is operatively associated with the outlet 12 for disposal of the waste. A wax seal 14 is included for sealing the outlet 12, wherein outlet 12 is attached to outlet line 16.

Figure 2:
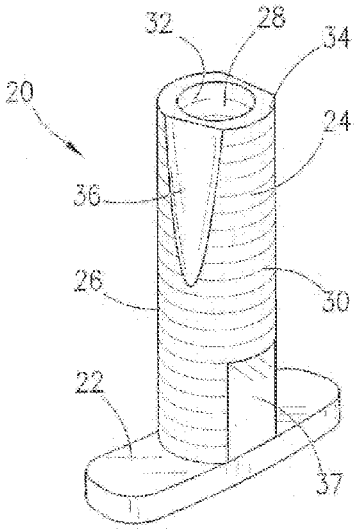
FIG. 2 is a perspective view of one embodiment of the fastener assembly.

FIG. 2 is a perspective view of one embodiment of the fastener assembly 20 of the present disclosure. The fastener assembly 20 includes a base 22 that is configured to be inserted into the a flange slot (not seen in this view). As shown, the base 22 is curved in order to cooperate with the floor flange. Extending from the base 22 is the bolt shaft 24, where in one embodiment, the bolt shaft is fixed to the base 22 such as by welding. Alternatively, the base 22 and bolt shaft 24 can be integrally constructed or attached with thread means. The bolt shaft 24 contains an outer cylindrical surface 26 and an inner bore 28. In one embodiment, the outer surface 26 contains an outer thread member 30 and the inner bore 28 contains an inner thread member 32.

As further shown in FIG. 2, the bolt shaft 24 contains a distal end 34 that has a top taper (also referred to as a distal indentation), shown generally at 36, for cooperation with an aperture contained within the foundation of the toilet. The distal indentation 36 is to fit into the apertures (openings) in the foundation of the toilet which are not necessarily all the same width in the various commercially available toilets. A bottom indentation 37 (also referred to as a proximal indentation 37) may be provided to allow for the bolt assembly to fit various width flange slots; in one embodiment, the distal indentation 36 is in a perpendicular plane as compared to the proximal indentation 37. In other words, the distal indentation 36 is in a first orientation and the proximal indentation 37 is in a second orientation opposite the distal's indentation's orientation. Toilets bolt to a floor flange and floor flanges are attached to a sub floor and/or drain pipe.

Figure 3B:
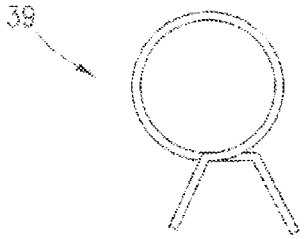
FIG. 3B is a perspective view of a lock spring.
Figure 3A:
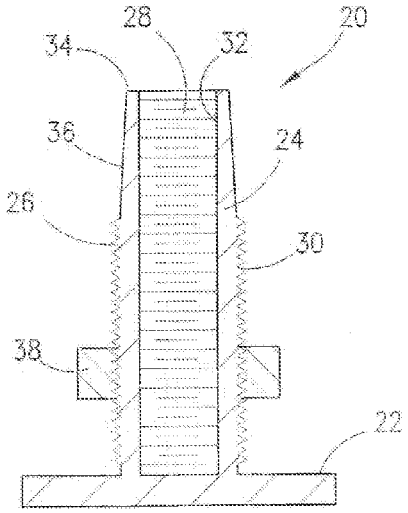
FIG. 3A is a cut-away side view of the fastener assembly of FIG. 2.

Referring now to FIG. 3A, a cut-away side view of the fastener assembly 20 of FIG. 2 will now be described. It should be noted that like numbers appearing in the various figures refer to like components. The base 22 has extending therefrom the bolt shaft 24. The outer thread member 30 and the inner thread member 32 are depicted, as well as the distal indentation 36. FIG. 3A also depicts the nut member 38 which will engage the outer thread member 30. As seen in FIG. 3B, it should be noted that other fasteners besides the nut member 38 may be used, such as a lock spring 39 (seen in FIG. 3B).

Figure 4:
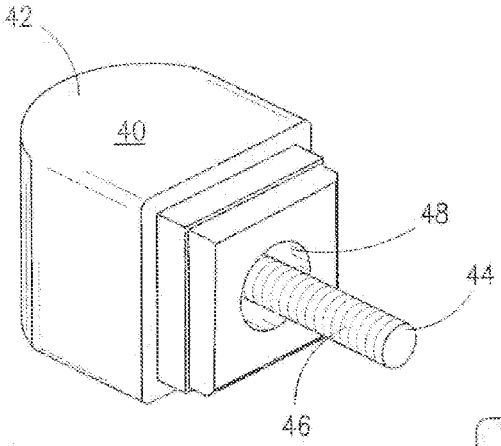
FIG. 4 is a perspective view of one embodiment of the cap.
Figure 5:
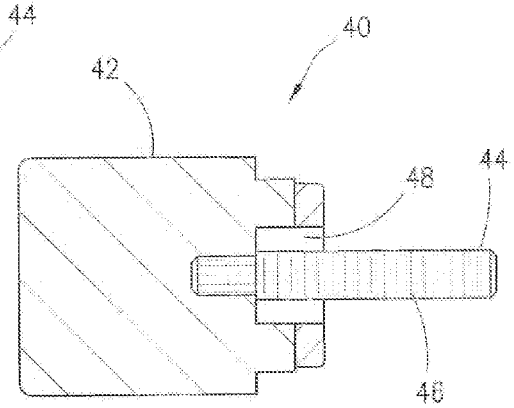
FIG. 5 is a side view of the cap of FIG. 4.

FIG. 4 is a perspective view of one embodiment of the cap 40. The cap 40 will have a proximal gripping end 42 where a user can grip and turn for tightening and/or removing, which in the embodiment shown is a rectangular box, but other gripping designs may be used. The distal end 44 is a shaft, wherein the distal end 44 will cooperate and engage with the inner bore 28 of the bolt shaft 24 (not shown in this figure). In one embodiment, the distal end 44 will have an outer thread member 46 that will threadedly engage with the inner thread member 32. The cap 40 also contains a receptacle, seen generally at 48, wherein the receptacle is an open area for placement of the bolt shaft 24 when the cap 40 is engaged with the bolt shaft 24. FIG. 5 is a side view of the cap 40 of FIG. 4. Hence, the open area of receptacle 48 is shown along with the distal end 44 and proximal gripping end 42. In the embodiment shown, outer thread member 46 is also shown.

Figure 6:
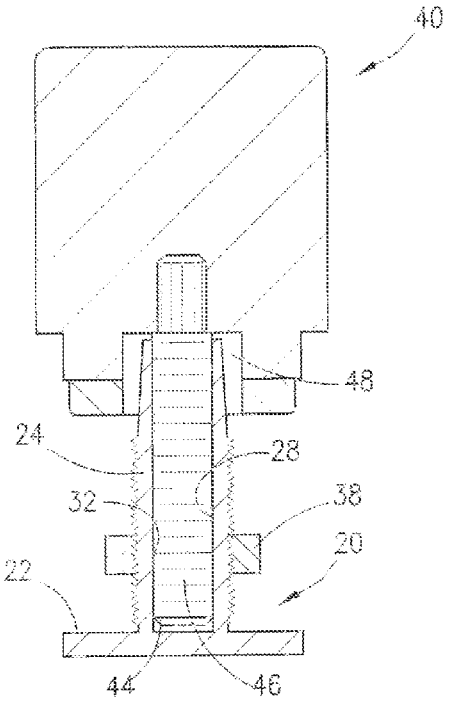
FIG. 6 is a cut-away side view of the cap engaged with the fastener assembly.

Referring now to FIG. 6, a cut-away side view of the cap 40 engaged with the fastener assembly 20 will now be described. The distal end 44 of the cap 40 is disposed within the inner bore 28, and in particular, the thread member 46 is engaging thread member 32. Also as shown, the bolt shaft 24 is disposed within the receptacle 48.

Figure 7:
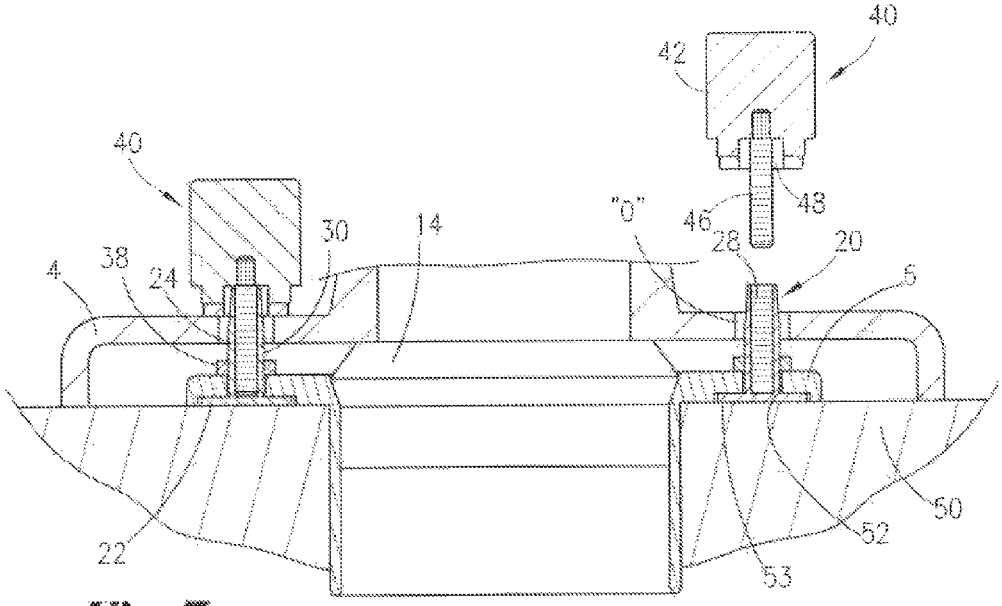
FIG. 7 is a cut-away side view of one embodiment of the apparatus with the flange in place.

FIG. 7 is a cut-away side view of one embodiment of the apparatus with the flange in place. More particularly, the flange 6 with associated wax ring 49 is in place relative to the floor 50. The fastener assembly 20 is positioned through the flange slot 52. As shown, the base 22 is engaging a bottom lip 53 of the flange 6, with the bolt shaft 24 extending from the flange slot 52. The nut member 38 is engaging the outer thread member 30. As noted earlier, other types of fasteners can be used such a lock ring that will engage with the outer member 30. In operation, the foundation 4 of the toilet is placed over the flange 6 and lowered so that the bolt shaft 24 extends from an opening "0" in the toilet foundation 4. Hence, the contractor can now simply grasp the gripping end 42 and fasten the cap 40 onto the bolt shaft 24. Also note that while one fastener assembly 20 have been described, generally at least two fastener assemblies as seen in FIG. 7 (one on each side of the toilet) are included per installation, as will be appreciated by those of ordinary skill in the art.

Figure 8:
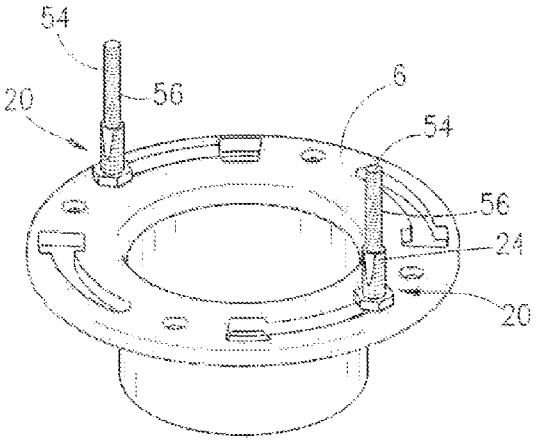
FIG. 8 is a perspective view of the fastener assembly, boltshaft, guidebolt with the floor flange.
Figure 9:
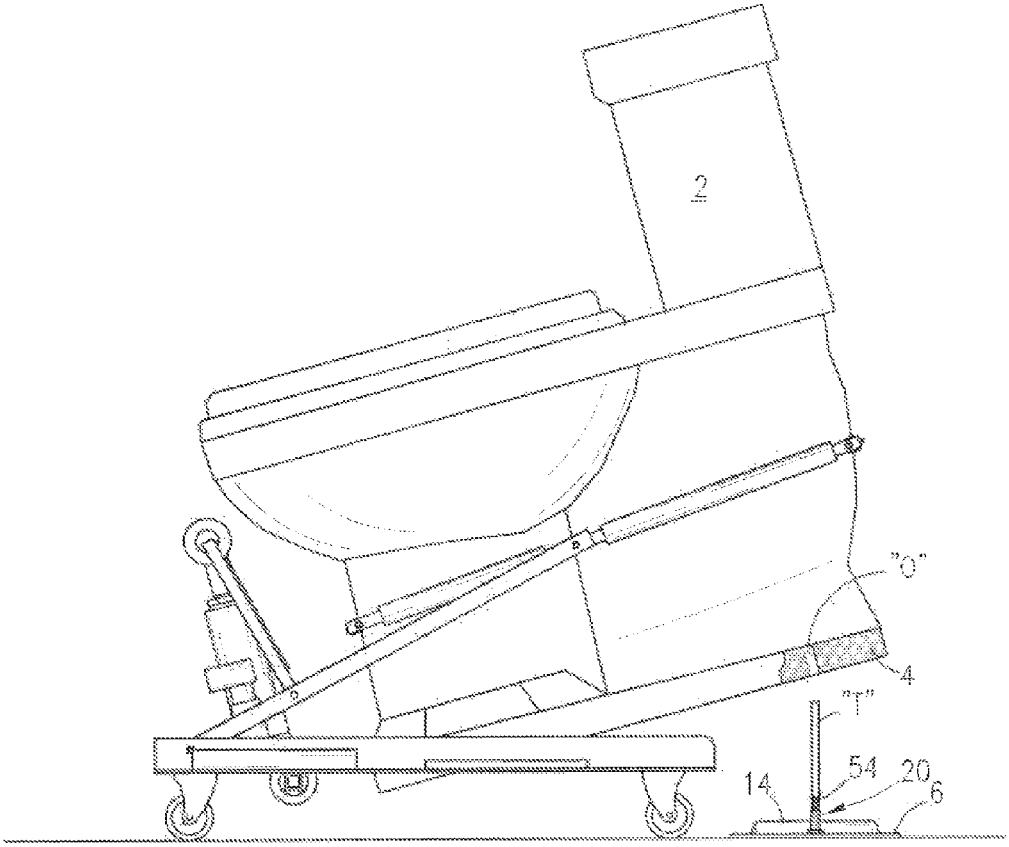
FIG. 9 is a side view of the toilet being lowered onto the fastener assembly.

In one embodiment, it is possible to utilize an apparatus for lifting and aligning toilets, such as disclosed in U.S. Pat. No. 7,798,469 which is incorporated herein by express reference. Thus, in one embodiment, a guide bolt 54 such as illustrated in FIG. 8 is utilized. The guide bolt 54 has an outer thread member 56 that will engage with the inner thread member 32 (not seen in this view) of the bolt shaft 24. In accordance with the teachings of this disclosure, in one embodiment as seen in FIG. 9 (which is a slide view of the toilet 2 being lowered onto the fastener assembly 20), the guide bolt 54 is positioned upright relative to the flange 6. The toilet 2 is lowered relative to the flange 6 (such as by the apparatus disclosed in U.S. Pat. No. 7,798,469), the guide bolt 54 is positioned through the openings O in the foundation 4 when lowering the toilet 2. The guide bolt 54 is then removed (by unscrewing, for instance), and then the cap 40 (not seen in this view) can be installed so that the flange 6 is attached to the toilet foundation 4. Also in this aligning process, alignment tubes "T" as noted in U.S. Pat. No. 7,798,469 can be placed over the guide bolts for easier lowering and aligning purposes.

Although the present invention has been described in terms of specific embodiments, it is anticipated that alterations and modifications thereof will no doubt become apparent to those skilled in the art. It is therefore intended that the following claims be interpreted as covering all such alterations and modifications as fall within the true spirit and scope of the invention.

I claim:

1. An apparatus for attaching a toilet to a flange, the toilet containing a foundation with an opening, said flange having a flange slot and a bottom lip, the apparatus comprising:

a fastener assembly operatively associated with the flange slot, wherein said fastener assembly comprises: a base; a bolt shaft with a flat top surface, an inner bore thread and an outer thread on an outer cylindrical surface, wherein said bolt shaft is connected to said base; and a nut threadedly attachable to said outer thread on said bolt shaft, wherein said base is configured to engage the bottom lip of the flange;

a guide bolt configured to selectively engage said fastener assembly and position the toilet in alignment relative to the flange slot; wherein said guide bolt is threadedly engaged with said inner bore thread of said bolt shaft; wherein said bolt shaft contains a distal indentation forming a top taper on the outer cylindrical surface of the bolt shaft so that as said guide bolt is positioned through the opening in the foundation, the distal indentation of said bolt shaft engages with the opening of the toilet foundation; and wherein the top taper extends only partially around the outer cylindrical surface;

a cap operatively configured to selectively engage said fastener assembly when said guide bolt is removed so that the toilet is attached to the flange.

2. The apparatus of claim 1 wherein said bolt shaft further contains a proximal indentation for cooperation with the flange slot, and wherein the outer thread of the bolt shaft extends to the base to allow for threaded adjustment of the nut along an entire length of the bolt shaft.

3. The apparatus of claim 2 wherein said cap has a proximal gripping end and a distal end, and wherein said distal end has an outer thread that engages with said inner bore thread of said bolt shaft.

4. The apparatus of claim 3 wherein said cap contains a receptacle, adjacent said distal end, for placement of said bolt shaft when said cap is engaged with said bolt shaft.

5. A method of attaching a foundation of a toilet to a flange, wherein the foundation contains an opening and said flange contains a flange slot, the method comprising:

a) providing a fastener assembly positioned through the flange slot, said fastener assembly including: a bolt shaft with a flat top surface, inner threads and outer threads on an outer cylindrical surface, wherein said bolt shaft is connected to a base, a nut threadedly attached to said outer threads of said bolt shaft and a guide bolt configured to threadedly engage said inner threads of said bolt shaft; a cap having a proximal gripping end and a distal end, and wherein said distal end contains an outer thread member and wherein said inner threads of said bolt shaft engages with said distal end's outer thread member;

b) inserting said fastener assembly into the flange slot;

c) fastening said fastener assembly to a bottom lip of the flange by threadedly engaging the nut with the outer threads of said bolt shaft;

d) positioning said guide bolt in an upright position relative to the flange;

e) lowering the toilet relative to the flange;

f) positioning said guide bolt through openings in the foundation when lowering the toilet, wherein said bolt shaft contains a distal indentation forming a top taper on the outer cylindrical surface of the bolt shaft, with the top taper extending only partially around the outer cylindrical surface, and the step of positioning said guide bolts through the openings in the foundation further includes engaging the distal indentation of said bolt shaft with the openings of the toilet foundation as the openings of the foundation are lowered over said guide bolts;

g) removing said guide bolt;

h) installing said cap onto said bolt shaft so that the toilet is attached to the flange.

6. The method of claim 5 wherein the step of installing said cap onto said bolt shaft includes threadedly connecting the distal end of said cap to said inner threads of said bolt shaft.

7. The method of claim 6 wherein threadedly connecting the distal end to said inner threads of said bolt shaft includes allowing said bolt shaft to advance into a receptacle formed on said cap.

8. The method of claim 7 wherein the step of positioning said guide bolt through the opening in the foundation includes placing an alignment tube over the guide bolt.

9. An apparatus for bolting down a flange for a toilet, the flange having a flange slot and a bottom lip, wherein the toilet containing a foundation having an opening, the apparatus comprising:

a fastener assembly disposed through the flange slot, wherein said fastener assembly comprises: a base configured to engage the bottom lip of the flange; a bolt shaft with a flat top surface, an inner bore threads and outer threads on an outer cylindrical surface, wherein said bolt shaft is connected to said base, and a nut selectively attachable to said outer threads of said bolt shaft, wherein said bolt shaft contains a distal indentation forming a top taper on the outer cylindrical surface of the bolt shaft for cooperation with the opening of the foundation, wherein the top taper extends only partially around the outer cylindrical surface, wherein said bolt shaft contains a proximal indentation for cooperation with the flange slot, wherein the outer threads of the bolt shaft extend to the base to allow for threaded adjustment of the nut along an entire length of the bolt shaft, and wherein the distal indentation is in a first orientation and the proximal indentation is in a second orientation opposite the distal indentation's first orientation;

a guide post configured to threadedly engage said inner bore threads of said bolt shaft in an upright position;

a cap operatively configured to selectively engage said bolt shaft, wherein said cap has a proximal gripping end and a distal end, and wherein said distal end is operatively configured to engage with said inner bore of said bolt shaft and wherein said distal end contains an outer thread member and wherein said inner bore threads of said bolt shaft engages with said distal end's outer thread member.

10. The apparatus of claim 9 wherein said cap contains a receptacle, adjacent said distal end, for placement of said bolt shaft when said cap is engaged with said bolt shaft.

* * * * *